US007654198B2

(12) United States Patent
Faber

(10) Patent No.: US 7,654,198 B2
(45) Date of Patent: Feb. 2, 2010

(54) TYPE UNIT OF A HAND STAMP INCLUDING A HOOD-SHAPED COVER

(75) Inventor: Ernst Faber, Wels (AT)

(73) Assignee: Colop Stempelerzeugung Skopek Gesellschaft m.b.H. & Co., KG, Wels (AT)

( * ) Notice: Subject to any disclaimer, the term of this patent is extended or adjusted under 35 U.S.C. 154(b) by 196 days.

(21) Appl. No.: 11/794,194

(22) PCT Filed: Jan. 18, 2006

(86) PCT No.: PCT/AT2006/000025

§ 371 (c)(1),
(2), (4) Date: Jun. 26, 2007

(87) PCT Pub. No.: WO2006/079129

PCT Pub. Date: Aug. 3, 2006

(65) Prior Publication Data

US 2008/0141881 A1 Jun. 19, 2008

(30) Foreign Application Priority Data

Jan. 25, 2005 (AT) ..... A 103/2005

(51) Int. Cl.
*B41K 1/40* (2006.01)
*B41K 1/36* (2006.01)

(52) U.S. Cl. ..... 101/111; 101/105; 101/327; 101/334

(58) Field of Classification Search ..... 101/327, 101/333, 334, 405, 406, 103–105, 111
See application file for complete search history.

(56) References Cited

U.S. PATENT DOCUMENTS 1,301,926 A * 4/1919 Folger et al. ..... 101/111

(Continued)

FOREIGN PATENT DOCUMENTS

AT 379 U1 9/1995

(Continued)

OTHER PUBLICATIONS

International Search Report for PCT/AT2006/00025, dated May 31, 2006.

*Primary Examiner*—Leslie J Evanisko
(74) *Attorney, Agent, or Firm*—Collard & Roe, P.C.

(57) ABSTRACT

A type unit (3) for a self-inking stamp (1) with at least one type band (32) placed over a drive wheel (33-36), the drive wheel being rotatably mounted in two legs (30) of a bearing member (28) and provided with an adjustment wheel (38), and with a hood-shaped cover (48) which includes at least one slot (51) for the passage of a circumferential part of the adjustment wheel (38) of the drive wheel (33-36) as well as snap-in elements (47) in the region of its free ends and which covers the at least one type band (32) in the region of the drive wheel (33-36) in a position releasably fastened by snapping in on the bearing member (28), wherein the two legs (30) of the bearing member (28) each have two projecting snap-in noses (44) on their outer side that faces away from the type band (32), and the cover (48) includes two cantilevering extensions (50) on each one of its two front sides, as snap-in elements (47) for snapping engagement with the snap-in noses (44) of the bearing member (28).

16 Claims, 11 Drawing Sheets

U.S. PATENT DOCUMENTS 1,330,251 A * 2/1920 Folger et al. ..... 101/111
1,401,436 A 12/1921 Pannier
4,064,802 A * 12/1977 Funahashi ..... 101/327
4,432,281 A 2/1984 Wall et al.
5,718,169 A 2/1998 Faber
5,950,535 A 9/1999 Faber
5,992,312 A 11/1999 Faber
2004/0255801 A1 * 12/2004 Shih ..... 101/111

FOREIGN PATENT DOCUMENTS

DE 203 09 613 U1 10/2003
EP 0 723 874 7/1996
WO WO 99/64246 12/1999

* cited by examiner

TYPE UNIT OF A HAND STAMP INCLUDING A HOOD-SHAPED COVER

CROSS REFERENCE TO RELATED APPLICATIONS

Applicant claims priority under 35 U.S.C. §119 of Austrian Application No. A 103/2005 filed Jan. 25, 2005. Applicant also claims priority under 35 U.S.C. §365 of PCT/AT2006/000025 filed Jan. 18, 2006. The international application under PCT article 21 (2) was not published in English.

BACKGROUND OF THE INVENTION

1. Field of the Invention

The invention relates to a type unit for a hand stamp or in a hand stamp, respectively, in particular for a self-inking stamp, comprising at least one printing type band which is placed over a drive wheel, said drive wheel being rotatably mounted in a bearing member and provided with an adjustment wheel, preferably being integrally formed therewith.

Furthermore, the invention relates to a drive wheel for such a type unit with at least one type band which, in its mounted position, is placed over the drive wheel, which drive wheel has a profiled wheel body and an adjustment wheel connected thereto, preferably integrally connected thereto.

2. The Prior Art

It has been known to equip self-inking stamps with type units which comprise one or more type bands for displaceable stamp types, these type bands being arranged in the type unit in loop-shape, partially looping over drive wheels which are connected to adjustment wheels so as to adjust the type bands in the type unit step-wise for moving the respective displaceable stamp type into its printing position. For example, such a self-inking stamp with such a type unit is known from EP 0 723 874 A. Usually, the loop-shaped type bands are also combined with stationary types in the type unit, and access to the drive wheels or to the adjustment wheels thereof, respectively, for adjusting the respective type band is only possible within a spatially limited region. Thus, it may happen that during displacement of the drive wheels, the fingers get in contact with the type bands that have been wetted with stamping ink from earlier actuations of the stamp, so that the fingers become soiled. To prevent this as far as possible, the diameters of the adjustment wheels can be made appropriately large which, however, undesirably increases the space demanded within the stamp housing additionally. Moreover, the adjustment wheels of the drive wheels usually must be thin so as to lose little space in the direction of the turning axle of such a stamp unit, apart from the fact that as a consequence of thicker adjustment wheels, the distance between the adjustable stamp types, as they are present in adjacent type bands, may become undesirably large for the respective imprint. As a result thereof—and also because the adjustment of the drive wheels, or of the type bands, respectively, must not be very smooth-running—the adjustment wheels cut relatively sharply into the fingertips during an adjustment, the more so, if the adjustment wheels are toothed or serrated on their circumference, as is common.

From AT 379 U1 it is already known to put a cover foil over the type bands as protection against soling of the fingers when displacing the adjustment wheels; this cover foil, which has slots for the passage of the adjustment wheels, is inserted in slots of a cross-member of the base for fixing the former, retention of said cover foil, however, being insufficient.

In DE 203 09 613 U1, furthermore, a type unit of the initially indicated type is shown, wherein a cover is provided which has triangular notches on the front sides, into which notches axially inwardly oriented snap-in projections, provided on the legs of a bearing member adjacent the base thereof, snap when snapping the cover onto said bearing member of the type unit. What is disadvantageous here is i.a. that snapping on of the cover and a possible later removal of the cover require quite an effort since an elastic deformation of the co-operating snap-in elements is possible to a limited extent only, wherein it may also easily happen that wall parts of the front side of the hood-shaped cover break off.

SUMMARY OF THE INVENTION

It is now an object of the invention to find a remedy for this situation and to propose a type unit as well as a drive wheel therefor, wherein a simple, easy, comfortable fastening and detachment of the cover is possible without the risk of a damage and, moreover, also a comfortable displacement of the type bands is possible without any problems and without the risk of soiling the fingers as well as particularly also without an unpleasant cutting of the rims of the adjustment wheels into the fingertips.

To solve this problem, the invention provides for a type unit for a hand stamp, or in a hand stamp, respectively, with at least one type band placed over a drive wheel, the drive wheel being rotatably mounted in two legs of a bearing member and provided with an adjustment wheel, and with a hood-shaped cover, and, furthermore, for a drive wheel that has a profiled wheel body. Advantageous embodiments and further developments are also disclosed.

With the technique according to the invention, a contact of the fingers with the stamping-ink-provided aggregate bands can simply be avoided by a hood-shaped cover that can be snapped on without any problems and is securely fixable, which shields off the type bands in the region in question which, however, allows access to the drive wheel(s) or, more precisely, to the adjustment wheels thereof, via the slot openings. As a consequence of the snap-in connection provided according to the invention, the cover can be particularly easily attached and removed, if desired, other than if the cover is screwed on, thus allowing for easy cleaning of the type bands or for exchanging of type bands, e.g.

This is particularly achieved by the location and the shape of the snap-in elements, as provided according to the invention, since then the snap-in elements are readily accessible and allow for a defined elastic deformation.

To effect the snap-in engagement or the snap-in connection, it has proven advantageous if the extensions which cantilever from the cover at the front side thereof carry a generally pin-shaped snap-in projection.

On the other hand, it is also suitable in this context if the snap-in noses each have an undercut snap-in groove on the legs of the bearing member.

For a comfortable effecting of the snap-in connection, it is also advantageous if the cover including the extensions consists of an elastically deformable synthetic material, such as ABS or PS, e.g. Here, moreover, it is suitable if the cover including the extensions is formed as an integral injection-molded part.

On the other hand, with a view to mounting of the drive wheels for the type bands it is advantageous if the bearing member including the snap-in noses is made of a comparatively stiff synthetic material, such as POM, e.g. Here, too, the bearing member including the snap-in noses preferably can be formed as an integral injection-molded part.

A particularly advantageous embodiment of the type unit according to the invention is characterized in that, via adjustment screws, the bearing member is connected to a base member which includes a passage opening for the respective type of the type band that is in its position of imprint, whereby the cover, which is in snap-in engagement with the bearing member, is co-adjustable when adjusting the bearing member relative to the base member, and in that the bearing member, externally on each leg front side, has a laterally open seat located between the snap-in noses and provided for the head of the adjustment screw, and the seat has a bottom formed by the snap-in noses and having a passage opening for the screw shaft, which passage opening is laterally open via a lateral slot. In this embodiment, the cover which is in snap-in engagement with the bearing member may simply be co-adjusted when displacing the bearing member relative to the base member. On the base member of such a type unit, a frame-shaped plate, in particular made of rubber, comprising the stationary stamp types may be attached, as is known per se. The base member, too, may be made of a rigid synthetic material, such as ABS or POM, e.g.

The (or each, respectively) drive wheel preferably has a soft circumferential region which is gripped by the fingertips, compared to the relatively harder synthetic material of the remaining drive wheel, in particular of the wheel body and/or of the inner region of the adjustment wheel. By this, an unpleasant cutting-in feeling is avoided at the fingers when gripping the respective adjustment wheel, wherein, due to the high friction of the soft synthetic material, nevertheless a safe adjustment of the drive wheels without slipping at the fingertip becomes possible. For an intimate connection of the two differently hard synthetic materials it has also proven advantageous if the radially inner, harder region of the adjustment wheel is formed with spokes-type extensions between which the softer synthetic material extends.

A particularly pleasant, softer synthetic material which may be used for the external circumferential region of the adjustment wheels is a thermoplastic elastomer. As the harder synthetic material, PS, ABS, PC or a combination of such synthetic materials may, e.g., be used. Preferably, the drive wheel is provided as a two-component injection-molded part.

BRIEF DESCRIPTION OF THE DRAWINGS

In the following, the invention will be explained in more detail by way of particularly preferred exemplary embodiments to which, however, it shall not be restricted, and with reference to the drawing. In the drawing, in detail.

DETAILED DESCRIPTION OF THE DRAWINGS

Figure 8A:
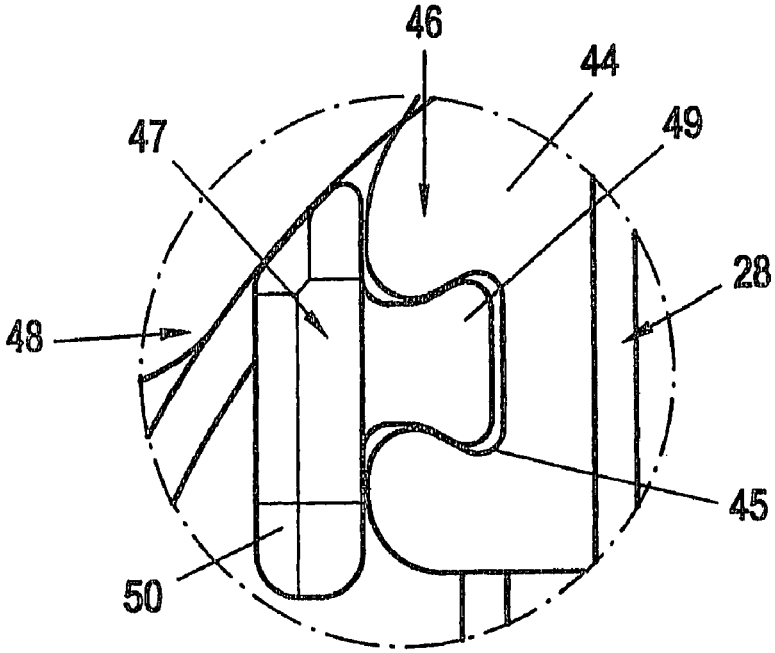
FIG. 8A shows a detail of this type unit according to arrow A in FIG. 8, to illustrate the snap-in connection between a cover and a bearing member of the type unit.
Figure 8:
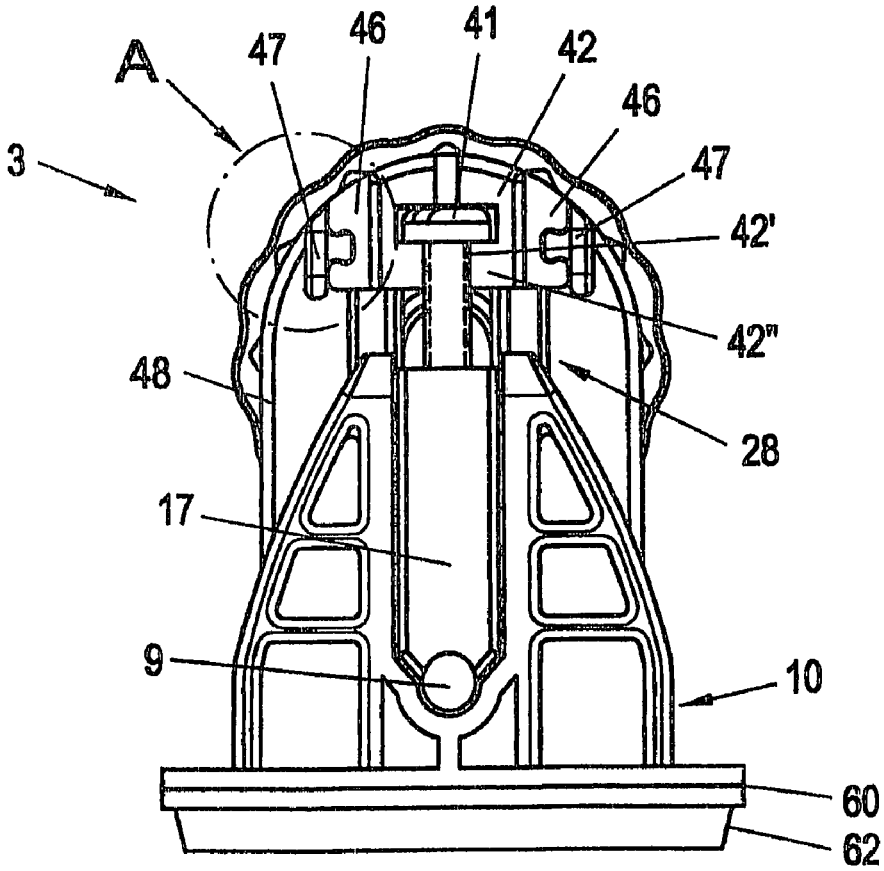
FIG. 8 shows a side view of the type unit.

In FIGS. 1 to 4, a self-inking stamp 1 with upper inking having a per se common basic construction and function is illustrated, which comprises a turning mechanism 2 for a stamp type unit 3. With the help of an actuating bow 5, the type unit 3 is upwardly and downwardly movable in a stamp housing 4 formed of two parts 4A, 4B and, thus, starting from an upper resting position illustrated in FIGS. 1, 2, and 4, in which the stamp types (not visible in FIGS. 1 to 4, yet cf. FIG. 5) contact an ink pad soaked with stamping ink within a drawer-like container 6 that can be pushed into and out of the stamp housing 4, is movable by 180° into a lower, turned imprinting position. The construction of the turning mechanism 2 is known per se, cf. e.g. U.S. Pat. No. 1,401,436 A or U.S. Pat. No. 4,432,281 A, and has rocker-shaped turning members 7 pivotably mounted on the upper end, having a curved control slot 8 for a turning axle 9. In the assembled state, this turning axle 9 extends through a base member 10 of the type unit 3, cf. also FIG. 8 in addition to FIG. 4; furthermore, the turning axle 9 extends through longitudinal slots 11 or 11A, 11B respectively (cf. FIG. 4) of the stamp housing 4, and it is fixed by means of bushing-type axle securing members 12 in legs 13 of the actuating bow 5. By means of pins 14, the turning members 7 are pivotably mounted in bores and and they carry inner pins 16 engaging in lateral guiding grooves 17 of the type unit 3 for turning the type unit 3 during its downward movement with the help of the bow 5 and the turning axle 9, cf. also FIG. 5.

Figure 1:
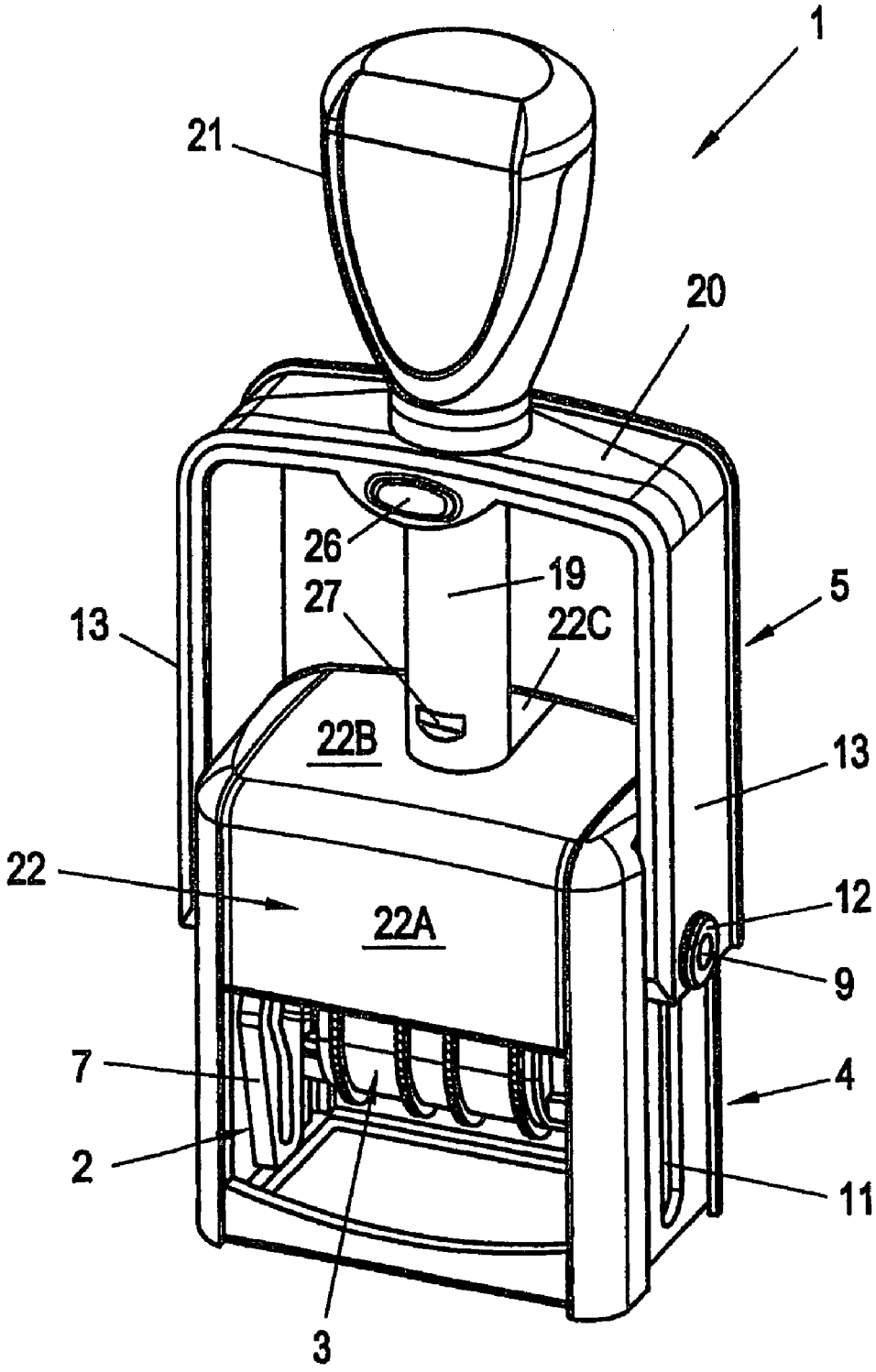
FIGS. 1 and 2 are perspective views of a self-inking stamp with a stamp unit comprising several type bands, viewed from two different sides.
Figure 2:
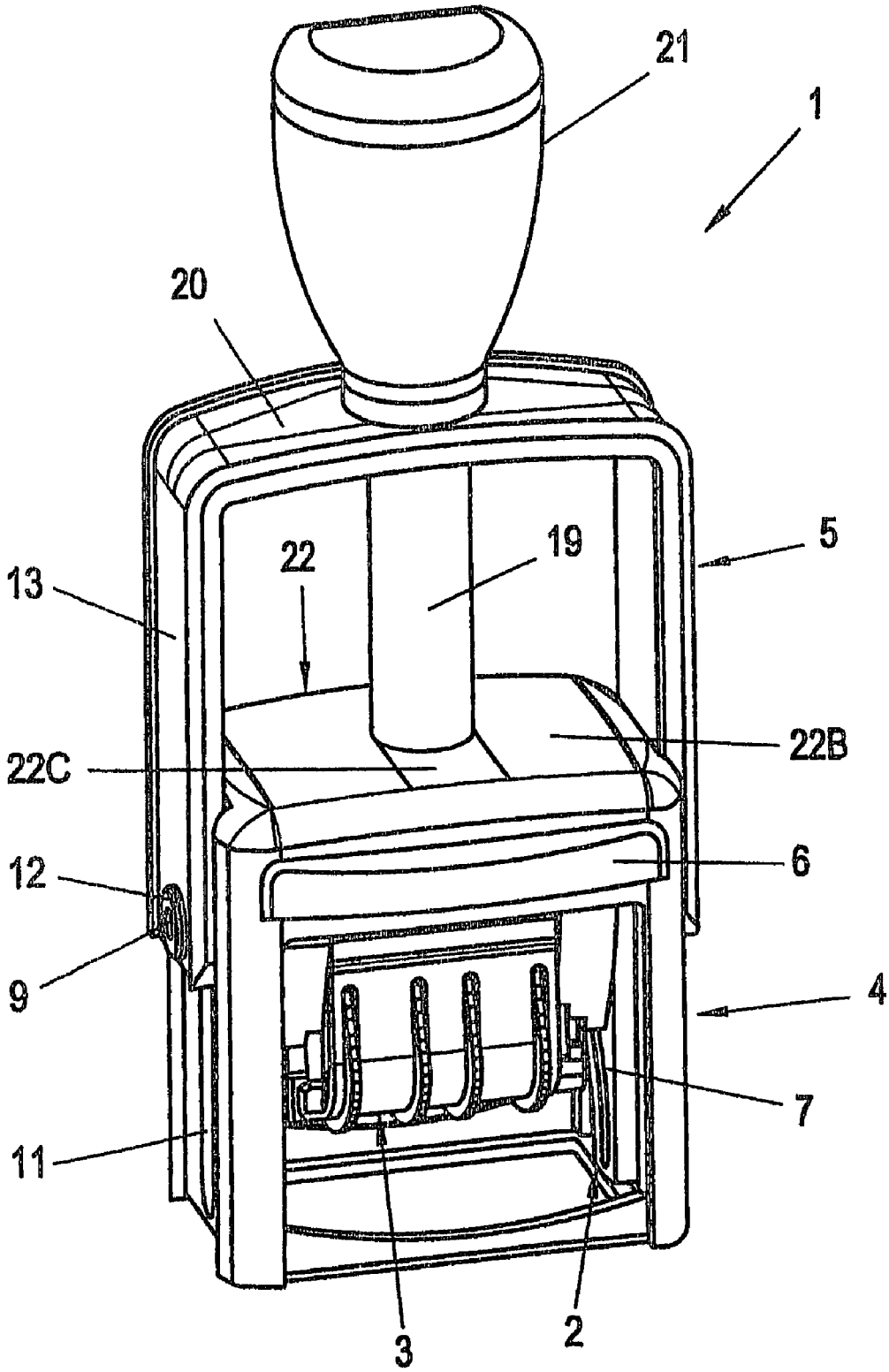
Figure 3:
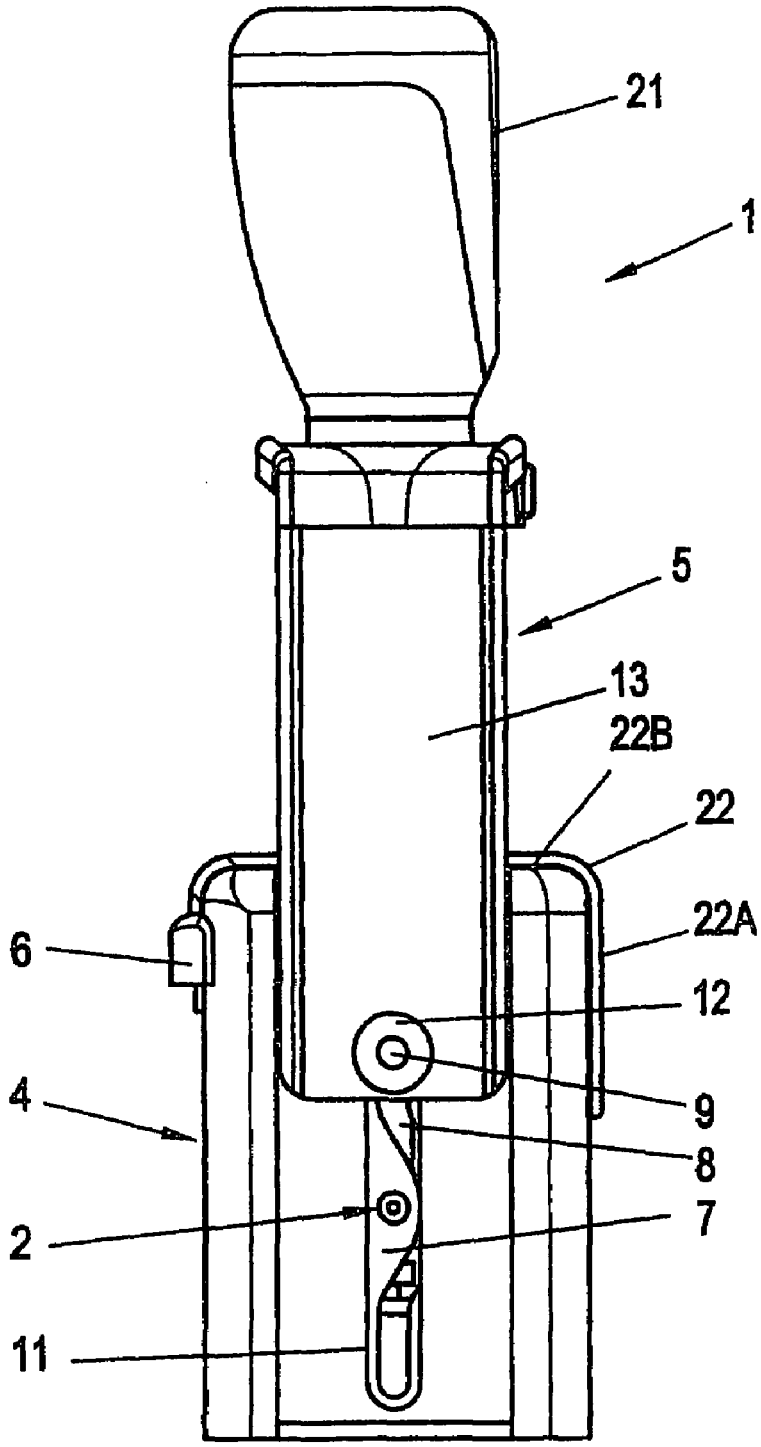
FIG. 3 is a side view of this self-inking stamp.

By means of a spring 18, in particular a helical compression spring supported on the upper side of the stamp housing 4, the actuating bow 5 is pressed in conventional manner into its upper resting position illustrated in FIGS. 1 to 3, and it is downwardly movable relative to the stamp housing 4 against the force of this spring 18. The spring 18 is accommodated in a tubular member 19 which extends into a handle 21 mounted on the upper side of the actuating bow 5, on the transverse part or web 20 thereof, the handle 21 and the tubular member 19 being telescopically moved within each other during actuation of the stamp 1.

Figure 4:
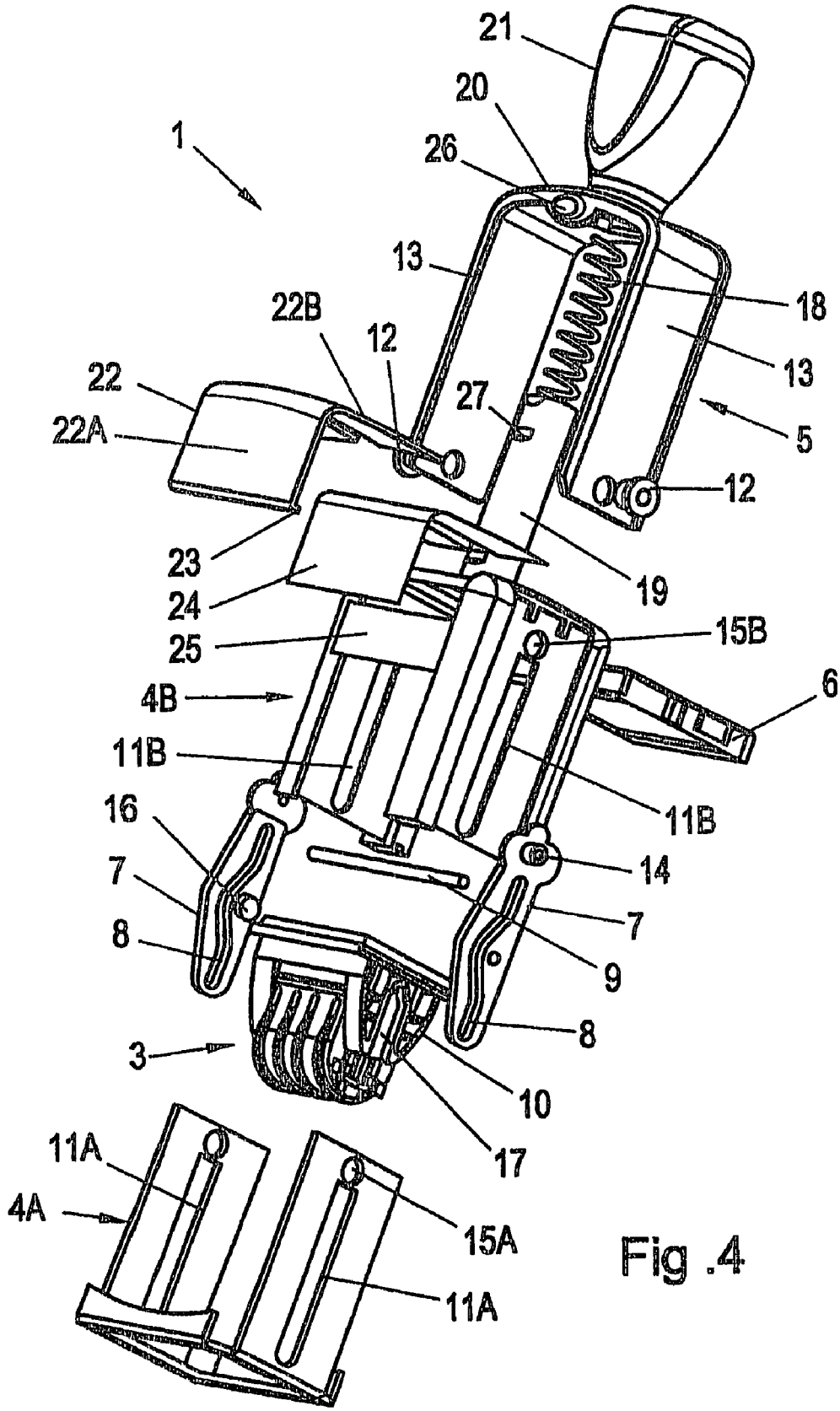
FIG. 4 shows the essential components of such a self-inking stamp in an explosion view.

On the stamp housing 4, furthermore, a text inspection window 22 of angular design with a comparatively large front area 22A and an upper cover area 22B is attached, a slot-shaped recess 22C being provided in said upper cover area 22B so as to be able to slip on the inspection window during attachment on the stamp housing 4, in particular by snapping on with the help of a lower, inwardly projecting snap-in ledge 23 (cf. FIG. 4), despite the tubular member 19, said tubular member 19 being received in this recess 22C in its mounted position, as best visible in FIG. 2. In FIG. 4, moreover, a comparably angularly designed text card 24 having an upper, rear slot is visible, this text card 24 offering a comparatively large area for an imprint—on its front side as well as on its upper side—for applying appropriate information regarding the stamp imprint etc. When attaching it in the inspection window 22, the text card 24 may be inserted by putting it on the snap-in ledge 23 and fixing it together with the latter on the stamp housing upper part 4B by putting it on the upper side thereof as well as by snapping in the snap-in ledge 23 with a transverse web 25 of the stamp housing upper part 4B.

From FIG. 1, finally also a push-button snap-in means 26 provided on bow 5 is visible, which cooperates with notches 27 on the tubular member 19 so as to enable fixing of the actuating bow 5 in the pre-determined position relative to the stamp housing 4, as is known per se.

As can be seen from FIGS. 5 to 10, the type unit 3 has a bearing member 28, also called housing bow in addition to the base member 10 that is also termed text plate body, which bearing member 28 is displaceably fixed in its vertical position relative to the base member 10 with the help of adjusting screws 29. The bearing member 28 preferably is designed as one-piece injection-molded member having two legs 30 and a supporting ledge 31 connecting these legs 30, said supporting ledge 31 serving to support type bands 32 (e.g. four type bands 32 for adjusting a date to be imprinted). The type bands 32 each extend over an associated drive wheel 33, 34, 35, 36, each of these drive wheels 33 to 36 having a wheel body 37 with a toothed-wheel-type profiled circumference, as well as an adjustment wheel 38 which preferably is integrally connected thereto. The drive wheels 33 to 36 are rotatably mounted in the bearing member 28 with the help of an axle 39, cf. FIGS. 9 and 10, so as to be able to manually adjust the type bands 32 with the help of the adjustment wheels 38 of the drive wheels 33 to 36 to the desired date or, generally, to the desired imprint.

Figure 10:
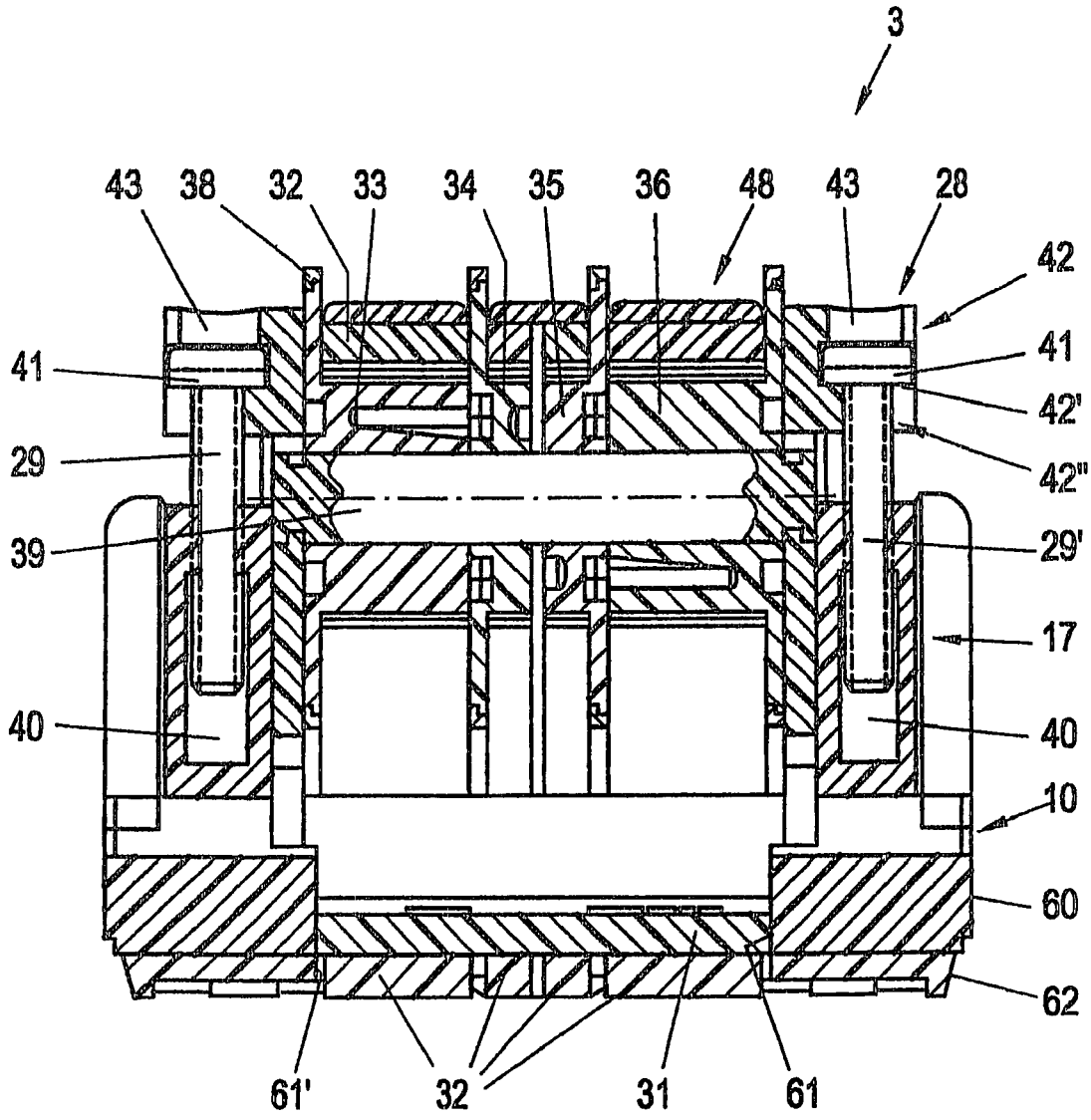
FIG. 10 shows a schematic sectional view along the longitudinal middle plane of this type unit, according to line X-X of FIG. 7.

The adjustment or adjusting screws 29 are screwed into seats 40 of the base body 10 that have inner threads, cf. FIG. 10, and the heads 41 of the adjustment screws 29 are received in laterally open seats 42 on the two front sides of the bearing member 28, and during mounting thereof, they are each at first pushed into these seats 42 from the side through a slot 42" provided in a bottom 42' until the shaft 29' of the adjustment screws 29 is located far enough inwardly so as to fit into the respective seat 40 of the base member 10, where it extends through a passage opening not further denoted in an orientation towards the seat 40 in the base member 10. The upper side of the screw head 41 of the respective adjustment screw 29 is then accessible for a tool, in particular a screw driver (not illustrated) through an upper opening 43 of the seat 42 for carrying out the required fixing and fine adjustment.

The seats 42 are formed at the two front sides of the bearing member 28, on the outer sides thereof, each between two noses 44 of the bearing member 28, each pair of such noses 44 being arranged in mirror-inverted fashion and, otherwise, practically the same design being provided for all the noses. In combination with snap-in grooves 45 particularly visible in FIGS. 8, 8A and 9, these noses 44 form snap-in elements 46 (and, accordingly, are also denoted as snap-in noses 44 hereinafter), and these snap-in noses 44 co-operate with correspondingly designed, co-operating snap-in elements 47 provided on a hood-shaped type band cover 48. In detail, the snap-in elements 47 of the cover 48 are formed by pin-shaped projections 49 provided on carrying-member extensions 50 which cantilever on the two front sides of the cover 48.

As has been mentioned, the cover 48 is hood-shaped having a configuration of U-shaped cross-section, and it includes slots 51 for the adjustment wheels or discs 38 of the drive wheels 33 to 36. These slots 51 extend from one upper arcuate region 52 of the cover 48 into the region of legs 53 of the cover 48. The portions 54 between the slots 51 cover the type bands 32 in their mounted position, cf. particularly FIG. 5, it thereby being avoided that the fingers of the user will become soiled with stamping ink by unintentionally contacting the type bands 32 when adjusting the type bands 32 via the drive wheels or their adjustment discs 38, respectively. The cover 48 may be fastened by snap-in engagement, i.e. "snapped on", on the bearing member 28 in a simple manner with the help of the projections 50 that snap into the snap-in elements 45 of the snap-in noses 44, and the cover 48 can also be detached from the bearing member 28 of the type unit 3 without any problems. Furthermore, when adjusting the bearing member 28 relative to the base part 10, the cover 48 is automatically co-adjusted, since it is mounted on the bearing member 28—and not on the base member 10.

Figure 9:
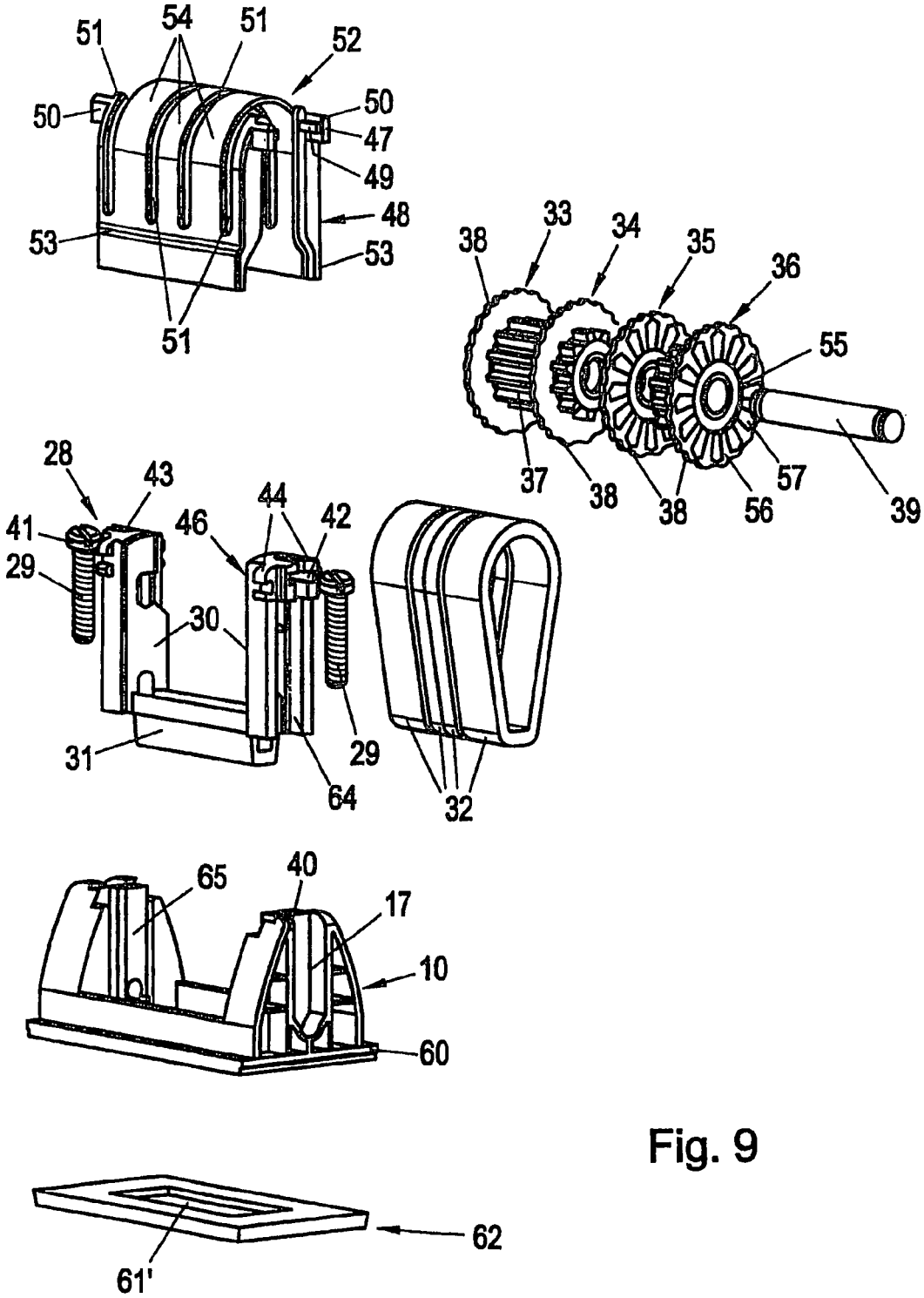
FIG. 9 shows the essential components of the type unit according to FIGS. 5 to 8 in an exploded view.
Figure 11:
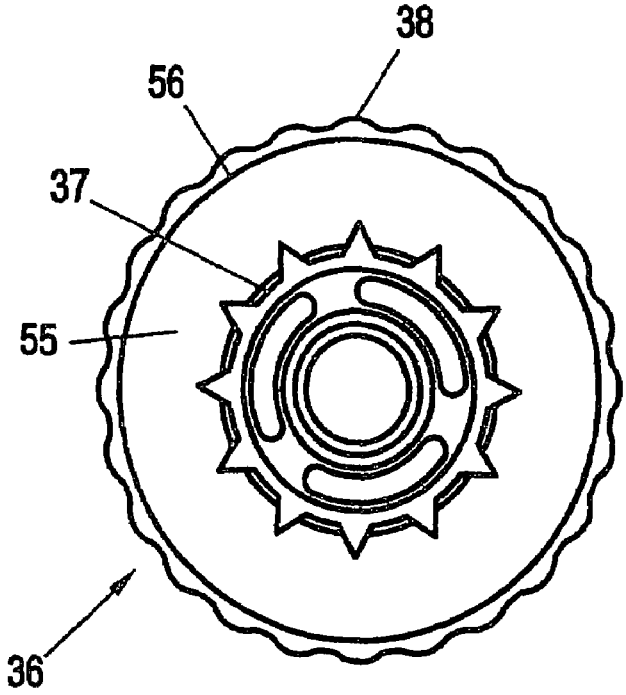
FIG. 11 shows a view of a drive wheel of such a type unit, viewed from the side of the wheel body.
Figure 12:
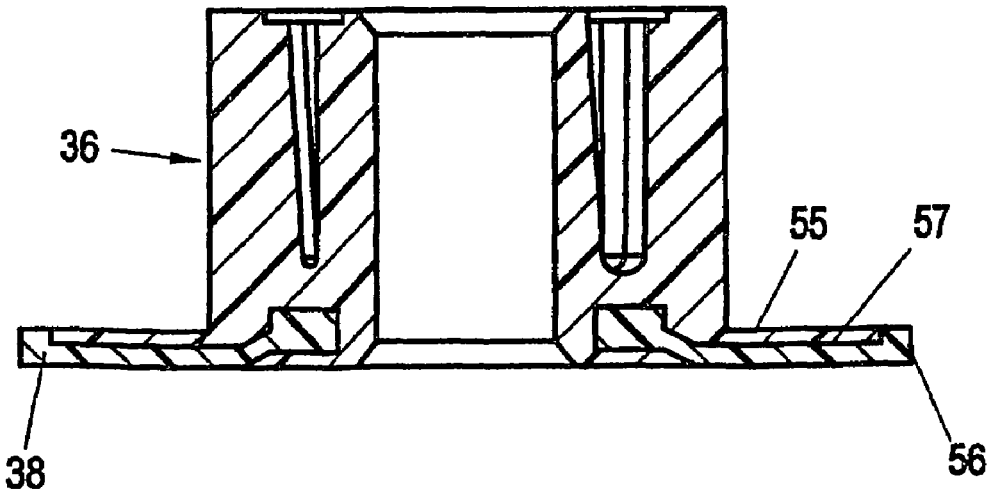
FIG. 12 shows an axial sectional view of this drive wheel to illustrate the design of this drive wheel as a two-component injection-molded member.

The drive wheels 33 to 36 are each designed as a two-component injection-molded member, cf. FIGS. 9, 11 and 12 (for the drive wheel 36 as an example), wherein the wheel body 37 as well as preferably also an inner region 55 of the respective adjustment wheel 38 is made of a comparatively harder material, whereas the radially external region or circumferential region 56 of the adjustment wheel 38 is made of a comparatively soft synthetic material. As the soft synthetic material, in particular a thermoplastic elastomer is used, whereas for the harder inner part of the drive wheels (wheel body 37 and/or inner region 55) polystyrene (PS), acrylonitrile-butadiene-styrene copolymer (ABS), polycarbonate (PC) or a combination of these materials, such as, in particular, PC-ABS, is used, e.g. The external, softer synthetic material gives a good feeling when gripping the adjustment wheels 38 with one's fingers and enables a particularly comfortable, easy rotating of the adjustment wheels 38 by means of the drive wheels 33-36. Moreover, the circumference of the adjustment wheels, as is particularly apparent from FIG. 11, may be corrugated or toothed in order to thereby also enhance the "grip" in addition to the high friction of the soft synthetic material.

For the drive wheel axle 39 preferably also a synthetic material, such as, in particular, polyoxymethylene (POM), is used; similarly, also the bearing member 28 may be injection-molded of POM or the like comparatively stiff synthetic material, just as the base member 10 may, e.g., be made of POM or also of ABS by injection-molding.

For the cover 48, preferably a synthetic material is used which is somewhat softer in comparison with the bearing member 28, wherein PS or ABS may particularly be used. The cover 48, too, preferably is produced as an integral injection-molded member.

As can then be seen from FIGS. 9 and 12, the harder inner material region 55 of the drive wheels 33 to 36 may be designed skeleton-like in the region of the adjustment discs 38, with spokes-type extensions 57, the softer synthetic material of the external region 56 extending into the gaps between these extensions 57; in this way, a firm composite of the two synthetic material components can be obtained when producing the drive wheels 33 to 36.

Figure 5:
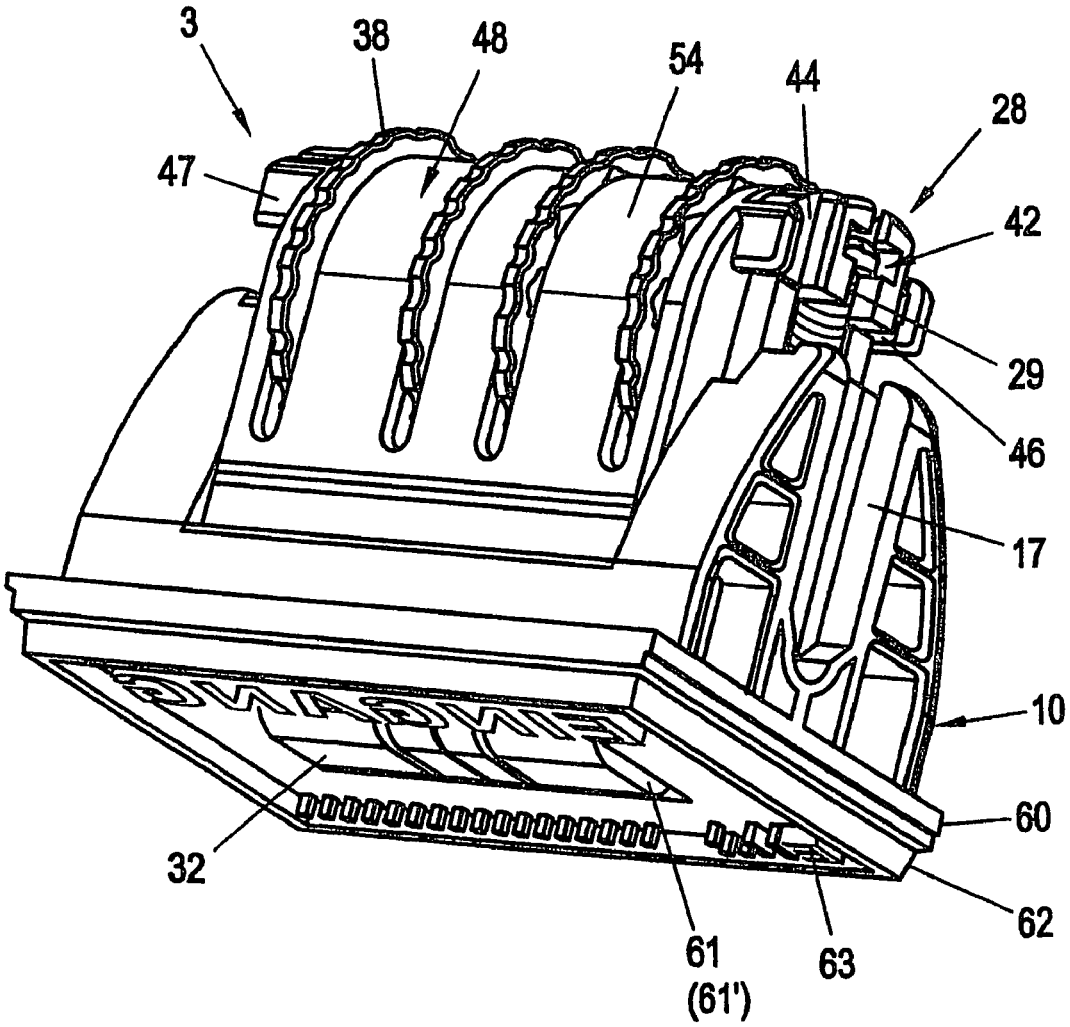
FIG. 5 shows a perspective view of one example of a type unit as may be inserted in such a self-inking stamp according to FIGS. 1 to 4.
Figure 6:
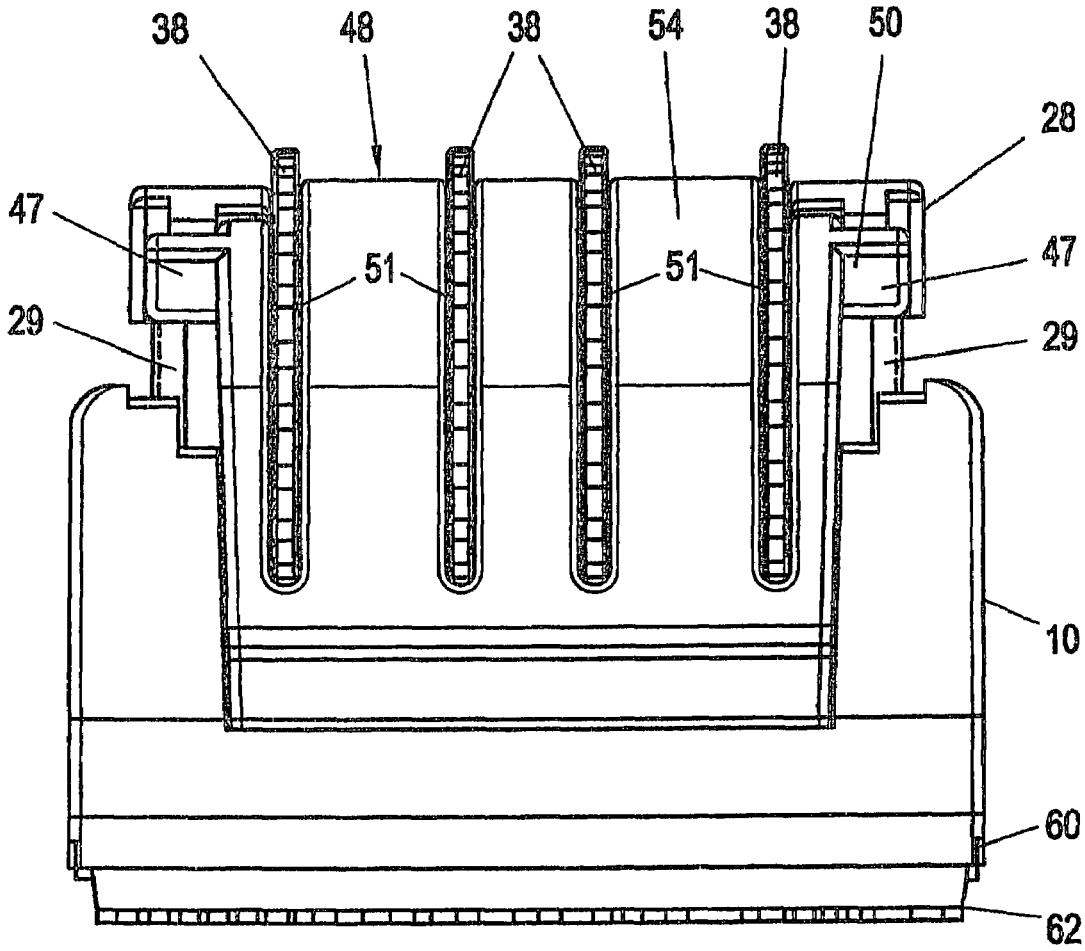
FIG. 6 shows a front view of this type unit.
Figure 7:
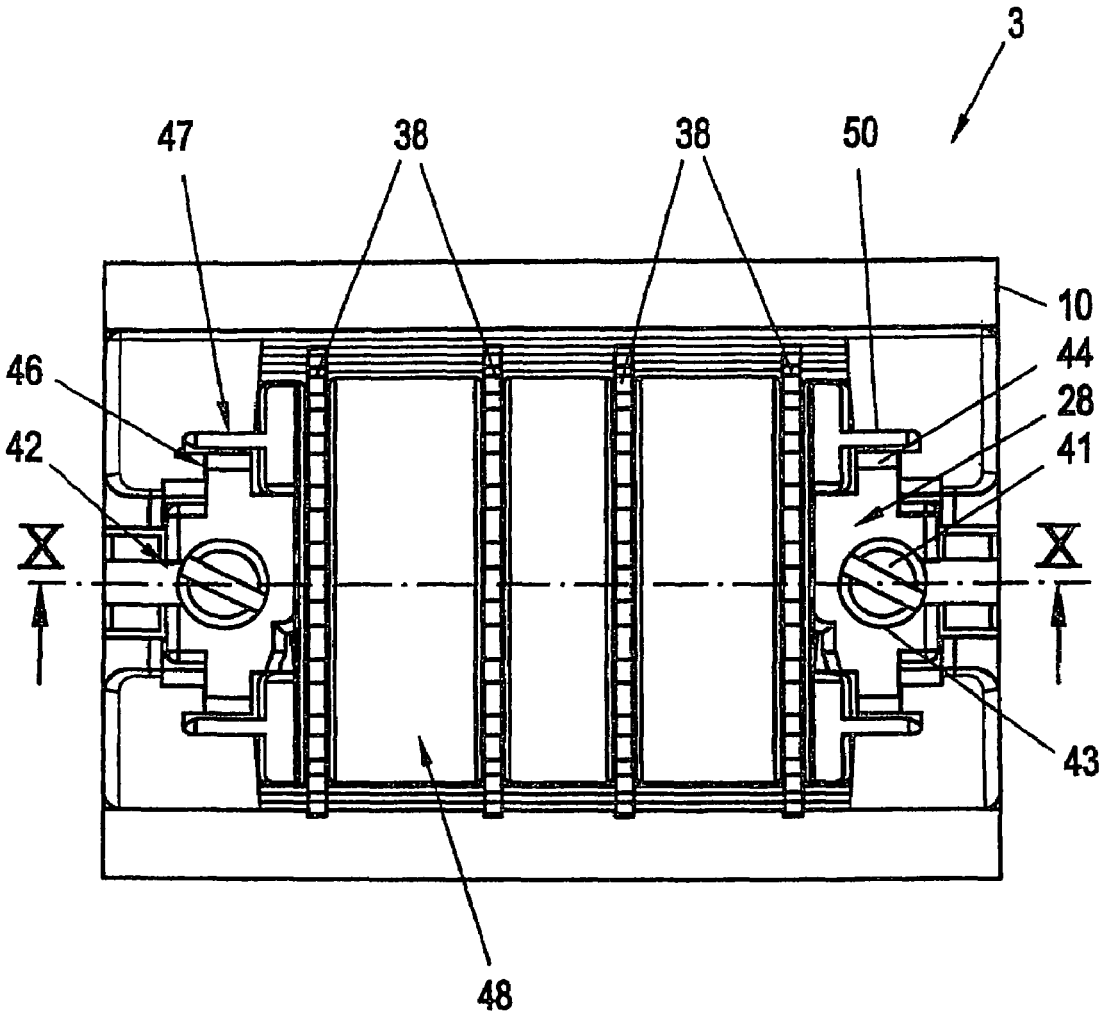
FIG. 7 shows a top view on this type unit.

As furthermore particularly visible from FIGS. 5, 9 and 10, the base member 10 has an—according to the illustration lower—frame part 60, with a passage opening 61 for the types of the type bands 32, which types are each supported by the supporting ledge 31 when making a stamp imprint, and to this frame part 60 a rectangular plate 62 with a corresponding passage opening 61' for the types of the type bands 22 is fastened, e.g. by gluing. This plate 62 consists of a synthetic or natural rubber having a hardness (Shore A) of from 50 to 55, and it is provided with stationary stamp types 63 visible in FIG. 5.

As can finally be seen in FIG. 9, the legs 30 of the bearing member 28 on their outer sides are provided with guiding channels 64 which cooperate with corresponding elongate, upright guiding projections 65 of the base member 10 to thereby guide the bearing member 28 on the base member 10 during mounting and adjustment and to secure it against lateral displacement.

The invention claimed is:

1. A type unit for a hand stamp, or in a hand stamp, respectively, with at least one type band placed over a drive wheel, said drive wheel being rotatably mounted in two legs of a bearing member and provided with an adjustment wheel, and with a hood-shaped cover which includes a curved portion covering at least one type band in the region of the drive wheel in a position releasably fastened by snapping in on the bearing member, and further includes at least one slot for passage of a circumferential part of the adjustment wheel of the drive wheel, wherein the two legs of the bearing member each have a free end where two projecting snap-in noses are formed on their respective outer side that faces away from the type band (32), and wherein the cover, in the region of its curved portion, comprises two cantilevering extensions on each one of its two front sides, as snap-in elements for snapping engagement with the snap-in noses of the bearing member.

2. The type unit according to claim 1, wherein the extensions cantilevering from the cover at the front side thereof carry a generally pin-shaped snap-in projection.

3. The type unit according to claim 1, wherein the snap-in noses each have an undercut snap-in groove on the legs of the bearing member.

4. The type unit according to claim 1, wherein the cover comprising the extensions consists of an elastically deformable synthetic material.

5. The type unit according to claim 1, wherein the cover comprising the extensions is formed as an integral injection-molded part.

6. The type unit according to claim 1, wherein the bearing member comprising the snap-in noses is made of a comparatively stiff synthetic material.

7. The type unit according to claim 1, wherein the bearing member comprising the snap-in noses is formed as an integral injection-molded part.

8. The type unit according to claim 1, wherein the drive wheel and the adjustment wheel are integrally formed.

9. The type unit according to claim 1, wherein, via adjustment screws, the bearing member is connected to a base member which includes a passage opening for respective type of the type band that is in its position of imprint, whereby the cover which is in snap-in engagement with the bearing member is co-adjustable when adjusting the bearing member relative to the base member, and wherein the bearing member externally on each leg front side has a laterally open seat located between the snap-in noses and provided for a head of the adjustment screw, and the seat has a bottom formed by the snap-in noses and having a passage opening for the screw shaft, which passage opening is laterally open via a lateral slot.

10. The type unit according to claim 9, wherein a frame-shaped plate with stationary stamp types is attached to the base member.

11. The type unit according to claim 9, wherein the base member consists of a rigid synthetic material.

12. The type unit according to claim 1, wherein said drive wheel comprises a profiled wheel body and wherein the adjustment wheel in an external circumferential region of the drive wheel comprises a softer synthetic material than a synthetic material of a radially inner region of the adjustment wheel or of the wheel body, respectively.

13. The type unit according to claim 12, wherein the radially inner, harder region of the adjustment wheel is formed with spoke-type extensions between which the softer synthetic material extends

14. The type unit according to claim 12, wherein the softer synthetic material is a thermoplastic elastomer.

15. The type unit according to claim 12, wherein the harder synthetic material is a synthetic material selected from the group consisting of PS, ABS, PC or a combination of such synthetic materials.

16. The type unit according to claim 12, wherein said drive wheel comprises a two-component injection-molded part.

* * * * *